US009827684B2

(12) United States Patent
Van Toor et al.

(10) Patent No.: US 9,827,684 B2
(45) Date of Patent: Nov. 28, 2017

(54) SHAVING DEVICE

(71) Applicant: KONINKLIJKE PHILIPS N.V., Eindhoven (NL)

(72) Inventors: Johannes Hendrikus Van Toor, Eindhoven (NL); Hans Oosterhoff, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/129,631

(22) PCT Filed: Apr. 24, 2015

(86) PCT No.: PCT/EP2015/058987
§ 371 (c)(1),
(2) Date: Sep. 27, 2016

(87) PCT Pub. No.: WO2015/169625
PCT Pub. Date: Nov. 12, 2015

(65) Prior Publication Data

US 2017/0144318 A1 May 25, 2017

(30) Foreign Application Priority Data

May 7, 2014 (EP) ..... 14167393

(51) Int. Cl.
*B26B 19/14* (2006.01)
*B26B 19/38* (2006.01)

(52) U.S. Cl.
CPC ..... *B26B 19/145* (2013.01); *B26B 19/3853* (2013.01)

(58) Field of Classification Search
CPC ..... B26B 19/145; B26B 19/3853
See application file for complete search history.

(56) References Cited

U.S. PATENT DOCUMENTS

| | | | | |
|---|---|---|---|---|
| 3,694,915 | A | 10/1972 | Beusink | |
| 3,715,803 | A | 2/1973 | Tyler | |
| 4,168,570 | A * | 9/1979 | Bakker | B26B 19/14 30/43.6 |
| 5,625,950 | A * | 5/1997 | Sterk | B26B 19/145 30/346.51 |
| 7,584,541 | B2 * | 9/2009 | Uchiyama | B26B 19/145 30/43.4 |

(Continued)

FOREIGN PATENT DOCUMENTS

| | | | |
|---|---|---|---|
| EP | 0719203 | B1 | 7/1996 |
| EP | 1862271 | A1 | 12/2007 |

(Continued)

*Primary Examiner* — Hwei C Payer

(57) ABSTRACT

The invention relates to a shaving head comprising at least one cutting unit (7, 7A, 7B). The cutting unit comprises a ring-like skin-supporting tilting member, being tillable relative to a shaving head main body (4, 8) about a first tilting axis, an external cutting member, an internal cutting member, and a retainer. According to the invention, the retainer is a multi-purpose retainer in that it provides simultaneously a locking function, a secondary tilting function and an anti-floating function. By virtue of the multi-purpose retainer, the shaving device delivers a high shaving performance and is also easy to clean.

10 Claims, 12 Drawing Sheets

(56) References Cited

U.S. PATENT DOCUMENTS

| | | | | |
|---|---|---|---|---|
| 7,664,156 | B2 | 2/2010 | Yamazaki | |
| 7,930,828 | B2 * | 4/2011 | Brada | B26B 19/14 30/43.4 |
| 8,230,601 | B2 * | 7/2012 | Shimizu | B26B 19/14 30/43.4 |
| 8,595,939 | B2 * | 12/2013 | Brada | B26B 19/14 30/43.4 |
| 9,027,251 | B2 * | 5/2015 | Schmitt | B26B 19/14 30/41 |
| 9,061,428 | B2 * | 6/2015 | Brada | B26B 19/14 |
| 9,216,513 | B2 * | 12/2015 | Brada | B26B 19/14 |
| 9,592,614 | B2 * | 3/2017 | Oosterhoff | B26B 19/145 |
| 2007/0124936 | A1 | 6/2007 | Okabe | |
| 2007/0256302 | A1 | 11/2007 | Okabe | |
| 2011/0308088 | A1 * | 12/2011 | Brada | B26B 19/14 30/43.6 |
| 2017/0144318 | A1 * | 5/2017 | Van Toor | B26B 19/145 |

FOREIGN PATENT DOCUMENTS

| | | | |
|---|---|---|---|
| EP | 2138283 | A1 | 12/2009 |
| WO | 9602368 | A1 | 2/1996 |
| WO | 2008010139 | A1 | 1/2008 |
| WO | 2010103425 | A1 | 9/2010 |

* cited by examiner

SHAVING DEVICE

This application is the U.S. National Phase application under 35 U.S.C. §371 of International Application No. PCT/EP2015/058987, filed on Apr. 24, 2015, which claims the benefit of International Application No. 14167393.9 filed on May 7, 2014. These applications are hereby incorporated by reference herein.

FIELD OF THE INVENTION

The invention relates to a shaving device for skin hairs. More specifically, the invention relates to a shaving head, which comprises at least one cutting unit. The cutting unit comprises an external cutting member and an internal cutting member. The external cutting member has a skin shaving surface, while the internal cutting member is drivable for movement along an opening structure in said skin shaving surface for cutting through hairs passing said opening structure.

BACKGROUND OF THE INVENTION

For such a shaving device it is desirable that the device delivers a high shaving performance and is also easy to clean. Generally speaking, a high shaving performance requires more complex designs of the shaving heads. These higher complexities generally result in more complicated cleaning of the shaving heads, particularly their cutting units.

SUMMARY OF THE INVENTION

It is an object of the invention to provide a shaving device delivering a high shaving performance, while allowing to be easily and adequately cleaned.

For this purpose, the invention provides a shaving head according to the "Multi-Purpose Retainer Principle", which abbreviative expression is used herein for ease of presentation and understanding. The expression will be defined and explained hereinbelow.

I. Multi-Purpose Retainer Principle

As used herein, a shaving head according to said Multi-Purpose Retainer Principle is a shaving head for use in a shaving device for skin hairs, said shaving head comprising a shaving head main body and at least one cutting unit, wherein said cutting unit comprises:

a ring-like skin-supporting tilting member, which comprises a ring-like skin-supporting surface, and which comprises two opposed first suspension parts, which are located at mutually different locations along the ring-like skin-supporting tilting member, and via which the skin-supporting tilting member is suspended relative to the shaving head main body in a first tiltable manner about a first tilting axis;

an external cutting member comprising a skin-shaving surface, which is interrupted by an opening structure for allowing hairs to pass;

an internal cutting member, which is drivable for movement along said opening structure in the skin-shaving surface of the external cutting member for cutting through hairs passing said opening structure; and a retainer;

and wherein:

said cutting unit has an assembled condition for operation of the shaving head and a disassembled condition for cleaning of the cutting unit, wherein the ring-like skin-supporting tilting member, the external cutting member, the internal cutting member and the retainer in the assembled condition and disassembled condition are, respectively, assembled and at least partly disassembled relative to one another;

in said assembled condition the cutting unit has a skin contacting surface for contacting skin during a shaving action, said skin contacting surface comprising said ring-like skin-supporting surface and said skin-shaving surface, wherein the skin-supporting surface at least partly surrounds the skin-shaving surface;

said assembled condition of the cutting unit is obtainable from said disassembled condition in an opened condition of the shaving head by manually bringing the retainer into a locked condition relative to other parts of the cutting unit, while said disassembled condition is obtainable from said assembled condition by manually bringing, in said opened condition of the shaving head, the retainer out of said locked condition;

the ring-like skin-supporting tilting member further comprises two opposed second suspension parts, which are located at mutually different locations along the ring-like skin-supporting tilting member, and via which in said assembled condition the external cutting member is suspended relative to the ring-like skin-supporting tilting member in a second tiltable manner about a second tilting axis extending at a non-zero angle relative to said first tilting axis; and said locked condition of the retainer in said assembled condition of the cutting unit corresponds to a relative orientation of the retainer within the cutting unit, which relative orientation of the retainer effectuates:

(i) that the external cutting member is suspended relative to the ring-like skin-supporting tilting member in said second tiltable manner; and (ii) that the external cutting member is disabled to translate over more than a play distance of 2.0 millimeter in a direction transverse to said second tilting axis.

As mentioned, said play distance is 2.0 millimeter. Preferably, however, said play distance is 1.0 millimeter, more preferably 0.5 millimeter, still more preferably 0.3 millimeter.

From the above recitation it follows that a shaving head according to the Multi-Purpose Retainer Principle comprises the abovementioned retainer, which simultaneously serves, inter alia, the following multiple purposes.

(1) Locking Function:

A first one of the multiple, simultaneous purposes is that this retainer can be manually operated for unlocking and locking, i.e. disassembling and assembling, respectively, the parts of the cutting unit. In view of this, said first purpose of the retainer will hereinafter also be referred to as the "locking function" effectuated by the retainer.

(2) Secondary Tilting Function:

A second one of the multiple, simultaneous purposes is that the retainer effectuates the said suspension of the external cutting member in said second tiltable manner, which, in simultaneity with the said suspension of the skin-supporting tilting member in said first tiltable manner, brings about that the skin shaving surface of the external cutting member is allowed to continuously and automatically adapt its orientation within the shaving head as a user moves the shaving head along a three-dimensionally curved skin surface. In view of this, said second purpose of the retainer hereinafter will also be referred to as the "secondary tilting function" effectuated by the retainer.

(3) Anti-Floating Function:

A third one of the multiple, simultaneous purposes is that the retainer effectuates that the external cutting member is disabled to translate over more than said play distance in a direction transverse to the second tilting axis. It is noted that shaving heads are known in which an external cutting member is enabled to translate over more than said play distance in a direction transverse to directions about which the external cutting member is allowed to tilt. An external cutting member being translatable in such a manner is sometimes referred to as a "floating" member. In view of this, said third purpose of the retainer hereinafter will also be referred to as the "anti-floating function" effectuated by the retainer.

In summary, the retainer of the shaving head according to the invention provides simultaneously the locking function, the secondary tilting function and the anti-floating function. Therefore, the retainer of the shaving head according to the invention hereinafter also is referred to as the "multi-purpose retainer".

The shaving head according to the invention has a high shaving performance, because of the secondary tilting function in combination with the anti-floating function. As explained, the secondary tilting function allows the external cutting member to continuously and automatically adapt its orientation within the shaving head as a user moves the shaving head along a three-dimensionally curved skin surface. Thanks to this continuously and automatically adaptable orientation, i.e. simultaneously about the two non-parallel tilting axes, the pressure contact between skin and shaving surface is kept very evenly distributed over the shaving surface. At the same time, thanks to the anti-floating function, the shaving surface is kept in contact, under firm pressure, with the skin during the continuously and automatically adapting orientations. In this respect it is noted that, with a view to enhancing orientation adaptability of the external cutting member to the three-dimensionally curved skin surface, floating may in principle be seen as an additional dimension. However, in combination with the recited tiltability about the two non-parallel tilting axes, floating would involve deteriorated pressure contact levels with the skin during the continuously and automatically adapting orientations. For these reasons, the combination of the secondary tilting function and the anti-floating function provides very evenly distributed and firm skin contact pressure levels, resulting in said high shaving performance.

Despite the fact that realizing a high shaving performance, generally speaking, requires more complex designs of the shaving heads, which results in more complicated cleaning of the shaving heads (especially of their cutting units), the shaving head according to the present invention is easy to clean. This is achieved thanks to the specific multi-purpose character of the multi-purpose retainer used in the present invention, which multi-purpose character includes said locking function of the retainer.

For example, if a user wants to clean the shaving head after shaving, he could for example open the shaving head so as to gain access to a multi-purpose retainer of an assembled cutting unit of the shaving head. In this opened condition of the shaving head, the multi-purpose retainer, being in its locked condition then, prevents that parts of the cutting unit, such as the internal cutting member and the external cutting member, accidentally fall out of the opened shaving head. Next, by simply unlocking the multi-purpose retainer, the secondary tilting function and the anti-floating function are automatically de-activated and the cutting unit may be disassembled for separate and effective cleaning of for example the internal cutting member and the external cutting member. After cleaning, the cutting unit may be reassembled again and locked by simply locking the multi-purpose retainer, which at the same time automatically re-activates the secondary tilting function and the anti-floating function. The shaving head can then be closed again.

I.A. Dual-Tilt-Following Retainer Embodiment

A preferred embodiment of the invention, hereinafter referred to as "Dual-Tilt-Following Retainer Embodiment", is characterized in that, in said assembled condition of the cutting unit, in which the retainer is in its locked condition, the retainer simultaneously follows:

- the tilting movement of the skin supporting tilting member relative to the shaving head main body in said first tiltable manner about said first tilting axis; and
- the tilting movement of the external cutting member relative to the ring-like skin supporting tilting member in said second tiltable manner about said second tilting axis.

Consequently, according to this Dual-Tilt-Following Retainer Embodiment, the retainer follows both of said two tilting movements of the external cutting member. This results in a compact design of the cutting unit.

I.A.(i) Snap Connection Secondary Tilt Embodiment

In a preferred embodiment of said Dual-Tilt-Following Retainer Embodiment, hereinafter referred to as "Snap Connection Secondary Tilt Embodiment", said two opposed second suspension parts of the ring-like skin-supporting tilting member comprise a first snap connection structure co-operating with a second snap connection structure of the retainer, wherein said locked condition of the retainer in said assembled condition of the cutting unit is provided by a snap connection between the first snap connection structure and the second snap connection structure. The application of said snap connection structures, which enable tilting about the second tilting axis, further promotes a compact design of the cutting unit, keeps the number of separate parts of the cutting unit low, and makes assembling and disassembling of the cutting unit user-friendly.

I.A.(ii) Additional Tilting Ring Embodiment

In another preferred embodiment of the abovementioned Dual-Tilt-Following Retainer Embodiment, hereinafter referred to as "Additional Tilting Ring Embodiment", the cutting unit further comprises a ring-like additional tilting member, wherein, as seen in the assembled condition of the cutting unit:

- the ring-like additional tilting member is assembled together with the ring-like skin-supporting tilting member, the external cutting member, the internal cutting member and the retainer;
- said ring-like additional tilting member is suspended relative to the ring-like skin-supporting tilting member in said second tiltable manner via said two opposed second suspension parts of the ring-like skin-supporting tilting member; and
- said ring-like additional tilting member comprises a third snap connection structure co-operating with a fourth snap connection structure of the retainer, wherein said locked condition of the retainer in said assembled condition of the cutting unit is provided by a snap connection between the third snap connection structure and the fourth snap connection structure.

The application of said ring-like additional tilting member allows the second tilting axis to be brought closer to skin level, which improves the behaviour of the external cutting member to continuously and automatically adapt its orientation within the shaving head when a user moves the shaving head along a three-dimensionally curved skin surface, while the application of said snap connection structures for connection between the ring-like additional tilting member and the retainer further promotes a compact design of the cutting unit, keeps the number of separate parts of the cutting unit low, and makes assembling and disassembling of the cutting unit user-friendly.

A preferred embodiment of the abovementioned Additional Tilting Ring Embodiment is characterized in that, as seen in the assembled condition of the cutting unit, the ring-like additional tilting member is prevented from contacting skin during the said shaving action. In other words, unlike the ring-like skin-supporting tilting member, the ring-like additional tilting member does not have a skin-supporting surface. This means that the ring-like additional tilting member does not require any space for accommodating the skin-supporting surface. Hence, within the skin-contacting surface of the cutting unit, there is no need to sacrifice part of the surface area of the skin-shaving surface for the benefit of the skin-supporting surface of the ring-like additional tilting member. This improves the shaving performance.

I.B. Single-Tilt-Following Retainer Embodiment

Another preferred embodiment of the invention, hereinafter referred to as "Single-Tilt-Following Retainer Embodiment", is characterized in that, in said assembled condition of the cutting unit, in which the retainer is in its locked condition, the retainer follows the tilting movement of the skin-supporting tilting member relative to the shaving head main body in said first tiltable manner about said first tilting axis, but the retainer does not follow the tilting movement of the external cutting member relative to the ring-like skin-supporting tilting member in said second tiltable manner about said second tilting axis. Since in this Single-Tilt-Following Retainer Embodiment the retainer does not follow the tilting movement of the external cutting member relative to the ring-like skin-supporting tilting member in said second tiltable manner about said second tilting axis, the retainer, and the way in which it is fitted within the cutting unit, can be designed in more simple, robust and reliable ways, which has a positive influence on the user-friendliness and lifespan of the retainer and the cutting unit.

A preferred embodiment of the abovementioned Single-Tilt-Following Retainer Embodiment is characterized in that:

- the ring-like skin-supporting tilting member comprises a first interlocking structure and the retainer comprises a second interlocking structure, said first interlocking structure co-operating with said second interlocking structure for realizing said locked condition of the retainer in said assembled condition of the cutting unit;
- the two second suspension parts of the ring-like skin-supporting tilting member comprise two first abutment parts, respectively;
- wherein, as seen in said locked condition of the retainer in said assembled condition of the cutting unit:
- the retainer comprises two second abutment parts, which are opposite to the two first abutment parts, respectively, with a first part of the external cutting member lying in-between one first abutment part and one second abutment part, opposite to said one first abutment part, and with a second part of the external cutting member lying in-between the other first abutment part and the other second abutment part; and
- said second tilting axis passes through said first part of the external cutting member and through said second part of the external cutting member, while abutment action of the first abutment parts and of the second abutment parts disables translation of the external cutting member in a direction transverse to said second tilting axis.

The realization of the Single-Tilt-Following Retainer Embodiment by means of said first abutment parts of the ring-like skin supporting tilting member and the second abutment parts of the retainer further results in improved simplicity, robustness and reliability of the retainer and the cutting unit.

As mentioned hereinbefore, for a shaving head according to the invention, the second tilting axis extends at a non-zero angle relative to the first tilting axis. In other words, the second tilting axis is not parallel to the first tilting axis.

In another preferred embodiment of the invention, which embodiment can be used in combination with any one of the abovementioned embodiments of the invention, the first tilting axis and the second tilting axis extend perpendicularly relative to one another. Such a perpendicular arrangement (i.e. there is a 90 degrees angle between first tilting axis and second tilting axis) in many shaving head arrangements is considered to result in the most preferable adaptation behaviour of the orientation of the skin-shaving surface of the external cutting member during shaving. However, other non-zero angles between first tilting axis and second tilting axis will work as well, although in many shaving head arrangements said adaptation behaviour will improve most if said non-zero angle is closer to 90 degrees according to said perpendicular arrangement.

As mentioned hereinbefore, for a shaving head according to the invention, the internal cutting member is drivable for movement along said opening structure in the skin shaving surface of the external cutting member, for cutting through hairs passing said opening structure. In principle, said movement of the drivable internal cutting member may comprise movements of various nature, such as reciprocating translative movement, (reciprocating and/or continuous) rotative movement, or a combination of reciprocating translative movement and (reciprocating and/or continuous) rotative movement.

In another preferred embodiment of the invention, which embodiment can be used in combination with any one of the abovementioned embodiments of the invention, said movement of the drivable internal cutting member comprises rotative movement about a rotation axis which is perpendicular to both the first tilting axis and the second tilting axis. The combination of twofold tiltability about the first and second tilting axes along with the driven rotative movement about an axis of rotation perpendicular to both these tilting axes allows achieving compact skin-contacting surfaces of the cutting unit, which at the same time provide highly effective shaving performances.

The invention may also be embodied in a shaving device for skin hairs, comprising:

- a shaving-device main body which is intended to be taken hold of by a user of the shaving device, and which serves for accommodating various members of the shaving device; and
- a shaving head according to any one of the abovementioned embodiments of the invention, the shaving head being connected or connectable to the shaving-device main body for operation of the shaving device.

BRIEF DESCRIPTION OF THE DRAWINGS

The abovementioned aspects and other aspects of the invention will be apparent from and elucidated with reference to the embodiments described hereinafter by way of non-limiting examples only and with reference to the schematic figures in the enclosed drawing.

It is noted that when the same reference signs are used throughout different figures of the abovementioned FIGS. 1-12B, these reference signs denote the same or similar parts or aspects.

DETAILED DESCRIPTION OF EMBODIMENTS

Reference is first made to FIGS. 1, 2, 3, 4, 5A-5E, which illustrate a shaving head 3 according to the abovementioned Multi-Purpose Retainer Principle, more in particular according to the abovementioned Dual-Tilt-Following Retainer Embodiment, still more in particular according to the abovementioned Snap Connection Secondary Tilt Embodiment.

Figure 1:
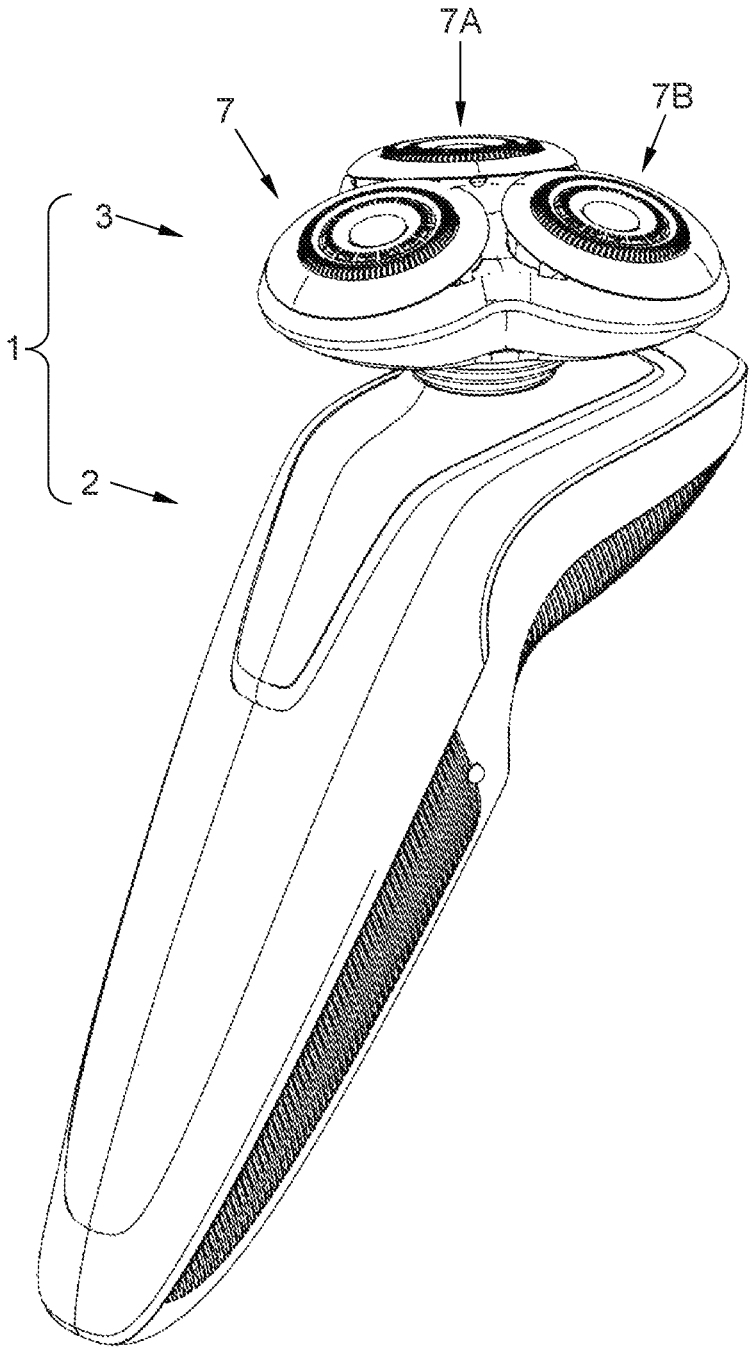
FIG. 1 shows, in a perspective view, an example of a shaving device according to the invention, which shaving device comprises an example of an embodiment of a shaving head according to the abovementioned Multi-Purpose Retainer Principle. More in particular, the shaving head of FIG. 1 is an example of the abovementioned Dual-Tilt-Following Retainer Embodiment. Still more in particular, the shaving head of FIG. 1 is an example of the abovementioned Snap Connection Secondary Tilt Embodiment.
Figure 2:
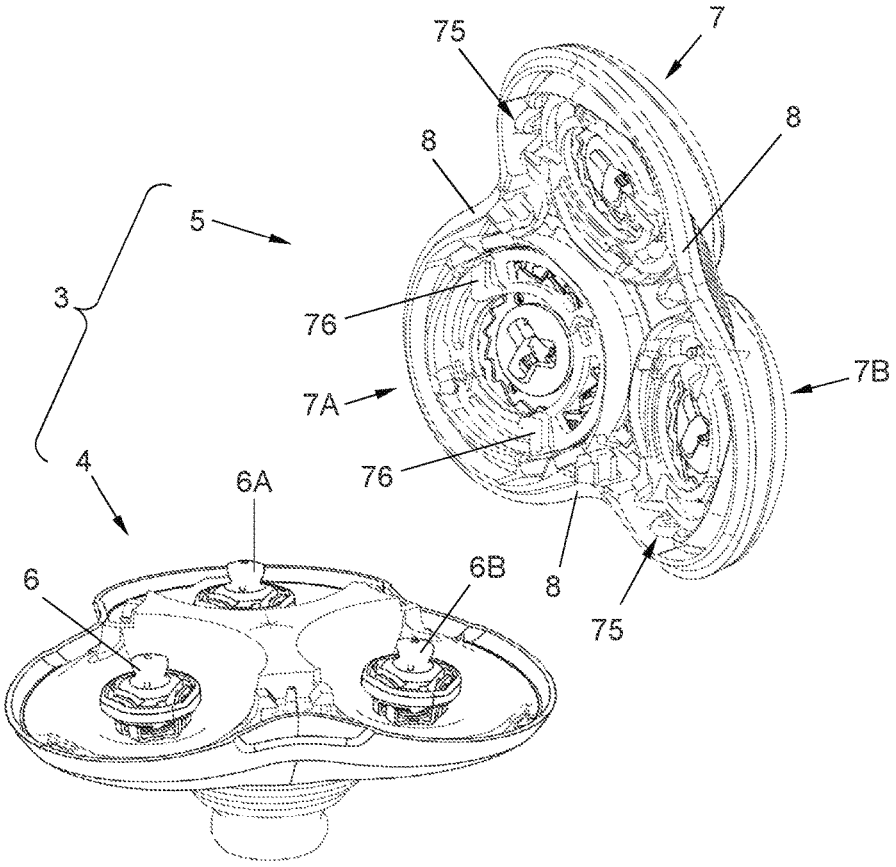
FIG. 2 separately shows, in a perspective view, the shaving head of FIG. 1 again, however, this time in an opened condition of the shaving head.

FIG. 1 shows the shaving device 1, which comprises the shaving-device main body 2 and the shaving head 3 being connected thereto, while FIG. 2 shows that the shaving head 3 can be taken apart into the two parts 4 and 5 shown. Part 5 has a frame 8 to which the three identical cutting units 7, 7A, 7B of the shaving head 3 have been connected. Part 4 has three driving shafts 6, 6A, 6B for driving the three internal cutting members 73 of the three cutting units 7, 7A, 7B, respectively. Part 4 and frame 8 of part 5 jointly constitute the shaving head main body, which carries the three cutting units 7, 7A, 7B.

Figure 3:
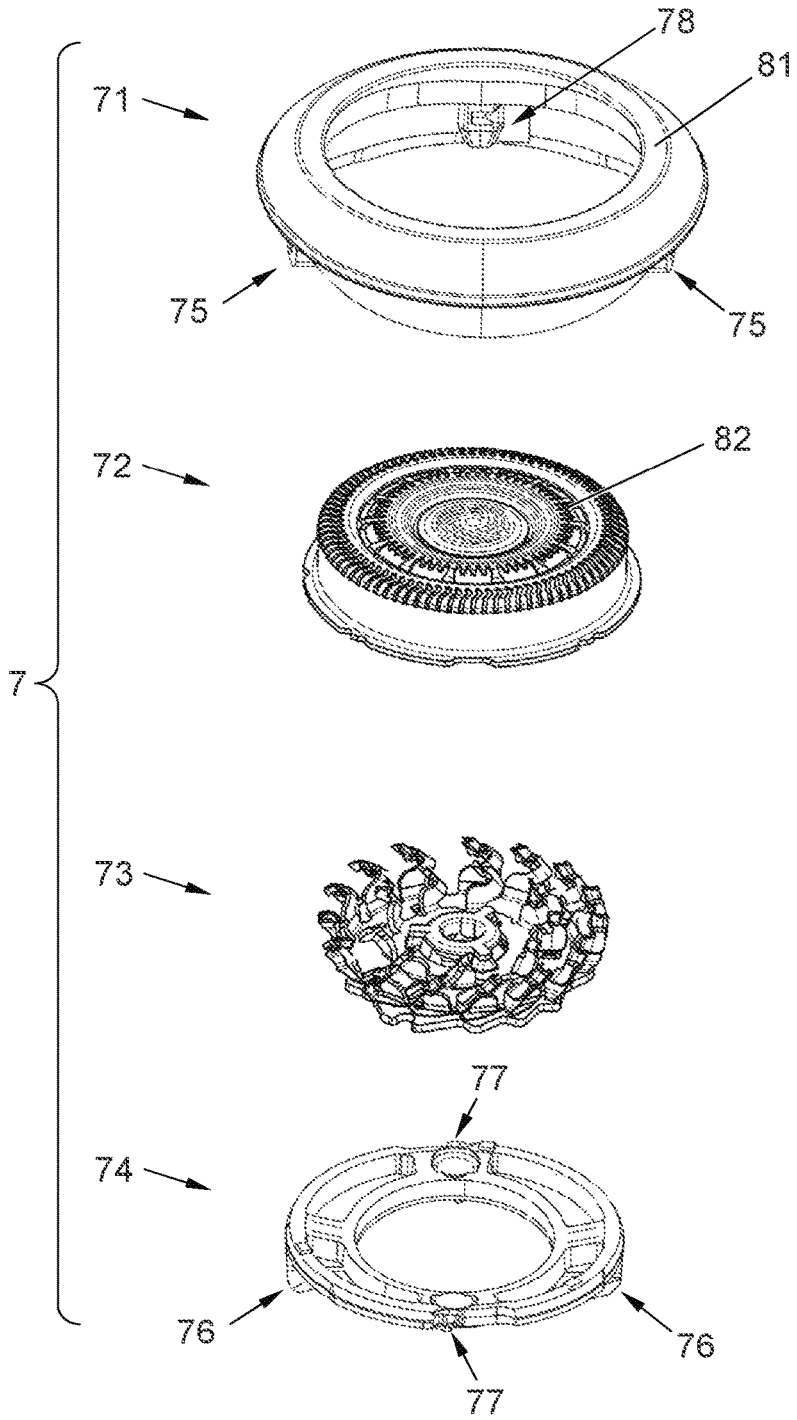
FIG. 3 separately shows, in a perspective view, one of the three identical cutting units of the shaving head of FIG. 2, in disassembled condition of the cutting unit shown.
Figure 4:
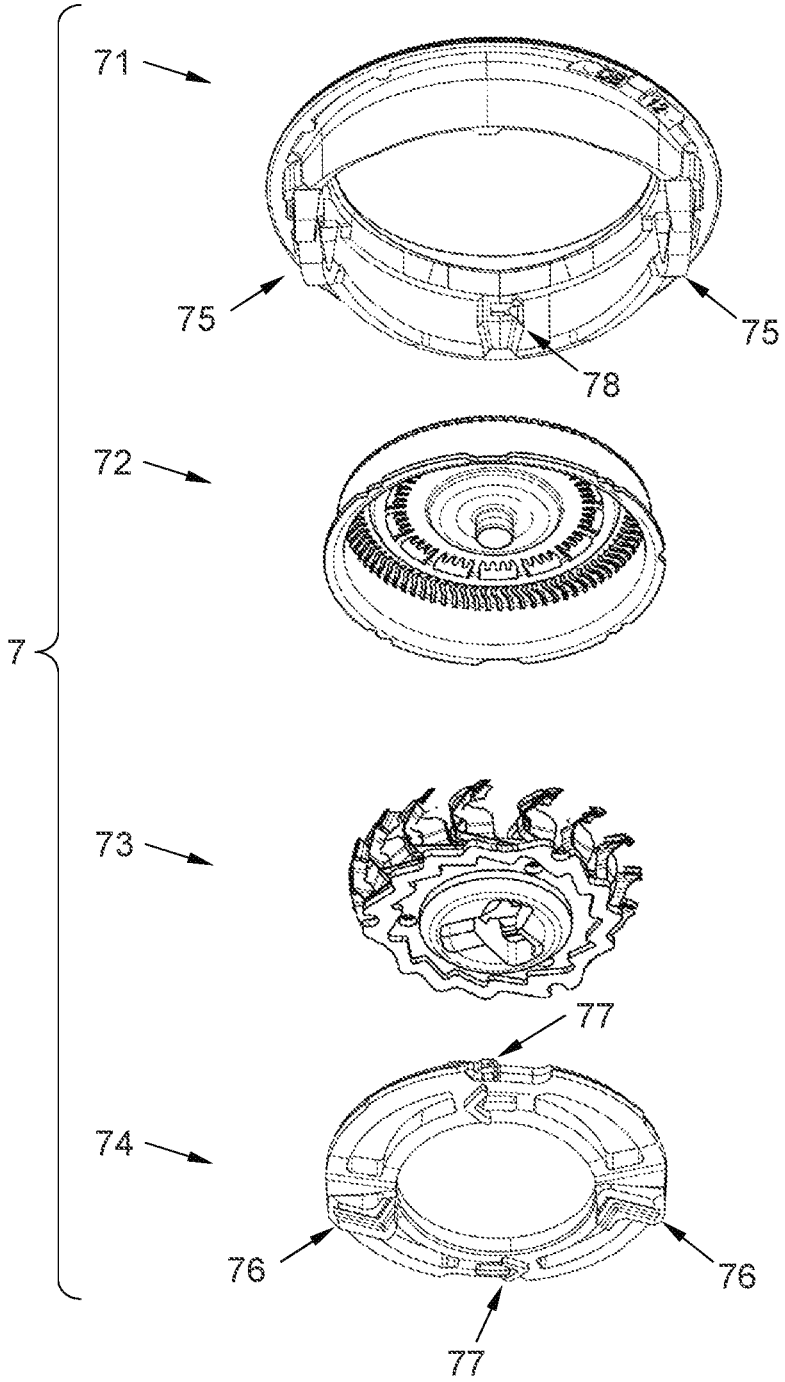
FIG. 4 shows the same situation as FIG. 3, however, the perspective view is taken in a different perspective direction.

The ring-like skin-supporting tilting member, the external cutting member, the internal cutting member, and the retainer of the cutting unit 7 are indicated by the reference numerals 71, 72, 73 and 74, respectively (best seen in FIGS. 3 and 4).

The two opposed first suspension parts of the ring-like skin-supporting tilting member 71 are indicated by reference numeral 75. Via these first suspension parts 75, and by means of a snap connection, the skin-supporting tilting member 71 is suspended relative to the frame 8 (see FIG. 2) in the said first tiltable manner about the first tilting axis. This tilting axis 11 has been indicated by reference numeral 11 in FIGS. 5A and 5B.

The abovementioned ring-like skin-supporting surface and skin-shaving surface are indicated by reference numerals 81 and 82, respectively, see FIG. 3. Together they form the abovementioned skin contacting surface for contacting skin during a shaving action, see FIGS. 5A and 5B.

FIGS. 3 and 4 show that the retainer 74 has two opposed radially extending pin-like protrusions 77, hereinafter referred to as the fulcrum pins 77, while the ring-like skin supporting tilting member 71 has two opposed radially extending recesses 78. Furthermore the retainer 74 has two opposed axially extending protrusions 76, hereinafter referred to as the finger grip elements 76.

Starting from its disassembled condition, shown in FIGS. 3 and 4, the cutting unit 7 can be brought into its assembled condition, shown in FIGS. 1, 2, and FIGS. 5A-5E, in the following manner. A user may insert the external cutting member 72 into the ring-like skin-supporting tilting member 71, and the internal cutting member 73 into the external cutting member 72, and then lock this external cutting member 72 and this internal cutting member 73 in-between the ring-like skin-supporting tilting member 71 and the retainer 74 in the following manner. The retainer 74 may first be axially translated into the ring-like skin-supporting tilting member 71 up to a point where the fulcrum pins 77 of the retainer 74 are at the same axial position as the recesses 78 of the ring-like skin-supporting tilting member 71. Next, the user may rotate the retainer 74, relative to the ring-like skin-supporting tilting member 71, around the axial direction so as to obtain a snap connection of the fulcrum pins 77 in the recesses 78. Said relative rotation of the retainer 74 is made easier thanks to the finger grip elements 76. Disassembling the cutting unit 7 may of course be done by performing the abovementioned steps in reverse order.

Figure 5A:
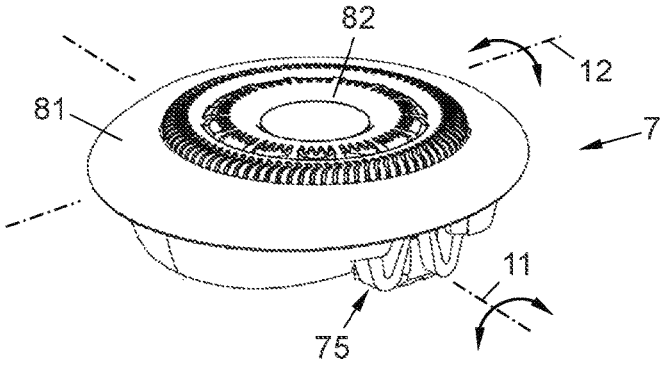
FIG. 5A shows, in a perspective view, the cutting unit of FIG. 3, however, this time in assembled condition of the cutting unit.
Figure 5B:
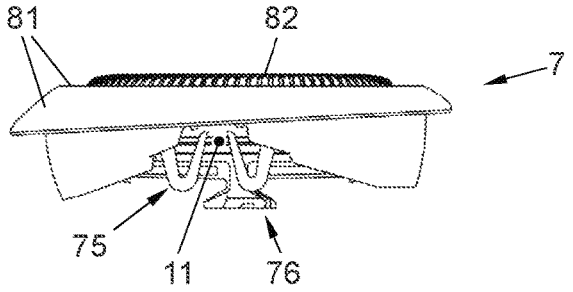
FIG. 5B again shows the assembled cutting unit of FIG. 3, however, this time in a first side view, which corresponds to a view in a direction parallel to the first tilting axis of the cutting unit shown.
Figure 5C:
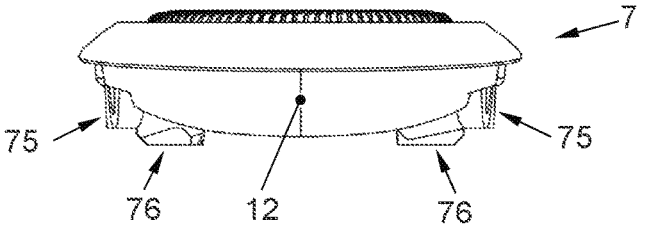
FIG. 5C again shows the assembled cutting unit of FIG. 3, however, this time in a second side view, which corresponds to a view in a direction parallel to the second tilting axis of the cutting unit shown.
Figure 5D:
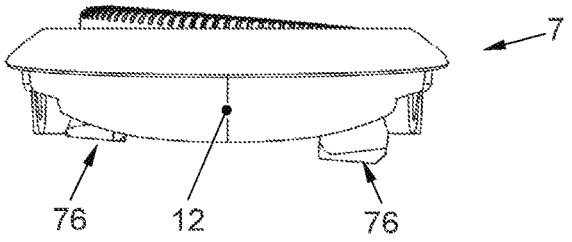
FIG. 5D again shows the situation of FIG. 5C, however, this time after, starting from the situation of FIG. 5C, the external cutting member has been tilted clockwise through a few degrees about the second tilting axis and relative to the ring-like skin supporting tilting member.
Figure 5E:
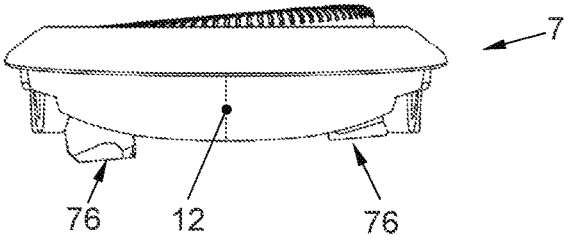
FIG. 5E also shows the situation of FIG. 5D, however, this time after said tilting through a few degrees has been performed in anti-clockwise direction.

Thus, in the assembled condition of the cutting unit 7, the fulcrum pins 77 are received in the recesses 78 in a pivotable manner. The result is that the external cutting member 72 is suspended relative to the ring-like skin-supporting tilting member 71 in the abovementioned second tiltable manner about a second tilting axis. This second tilting axis is indicated in FIG. 5A and FIGS. 5C-5E by reference numeral 12. It is noted that in said assembled condition the retainer 74 prevents the external cutting member 72 from translating in a direction transverse to the second tilting axis 12. It only allows the external cutting member 72 to tilt about the second tilting axis 12 as illustrated by FIGS. 5D and 5E.

From FIGS. 1, 2, 3, 4, 5A-5E it will now be clear that the retainer 74 simultaneously serves, inter alia, the multiple purposes as initially discussed herein, i.e. the "locking function", the "secondary tilting function", and the "anti-floating function". In other words, the shaving head 3 is in accordance with the abovementioned Multi-Purpose Retainer Principle. In addition, it is now clear that the retainer 74 in its locked condition simultaneously follows the tilting movement of the skin-supporting tilting member 71 relative to the shaving head main body 4, 8 about the first tilting axis 11, and the tilting movement of the external cutting member 72 relative to the ring-like skin-supporting tilting member 71 about the second tilting axis 12, which makes the shaving head 3 also a shaving head according to the abovementioned Dual-Tilt-Following Retainer Embodiment. Furthermore, it has been made clear that the shaving head 3 also is a shaving head according to the abovementioned Snap Connection Secondary Tilt Embodiment.

Now, reference is made to FIGS. 6, 7, 8A-8E, which illustrate a shaving head 103 according to the abovementioned Multi-Purpose Retainer Principle, more in particular according to the abovementioned Dual-Tilt-Following Retainer Embodiment, and still more in particular according to the abovementioned Additional Tilting Ring Embodiment.

Figure 6:
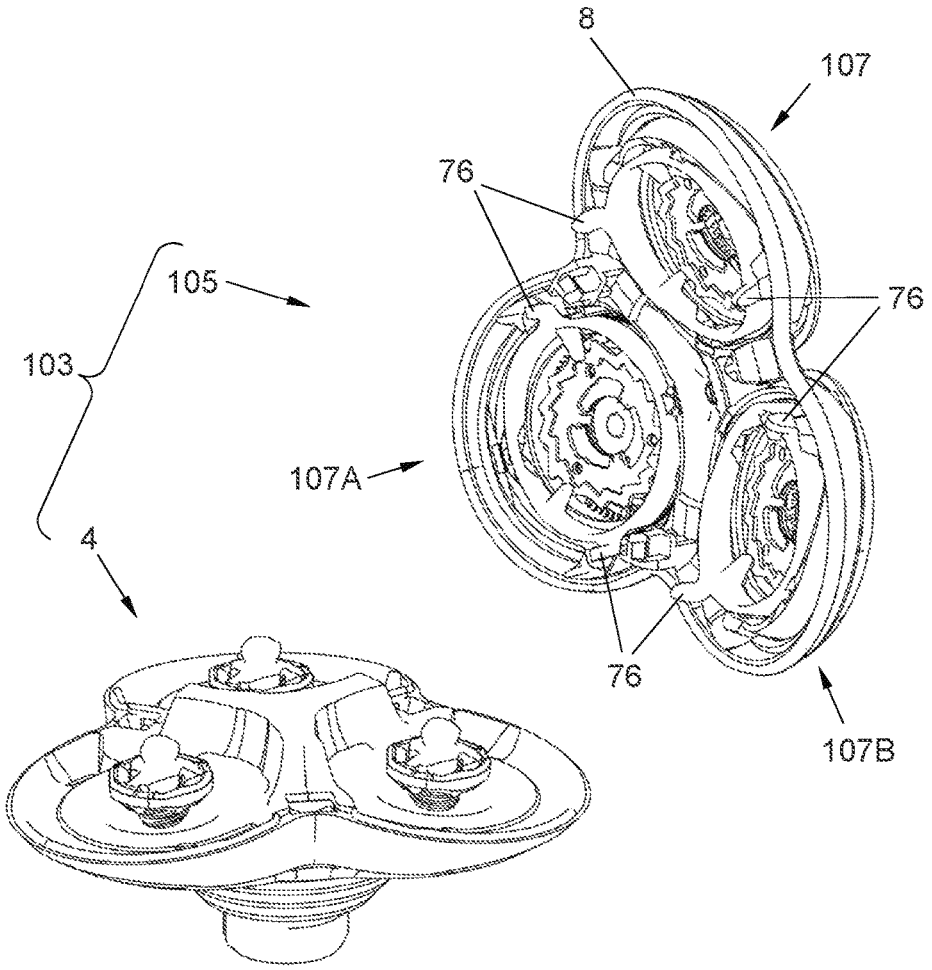
FIG. 6 again shows the situation of FIG. 2, however, the shaving head of FIG. 6 differs from the shaving head of FIG. 2, the difference only being that the shaving head of FIG. 6 has three identical cutting units, which are different from the three identical cutting units of the shaving head of FIG. 2. The shaving head of FIG. 6 also is an example of an embodiment of a shaving head according to the abovementioned Multi-Purpose Retainer Principle. In that sense, the shaving device of FIG. 1 remains a shaving device according to the invention if it contains the shaving head of FIG. 6 instead of the shaving head of FIG. 2. Just like the shaving head of FIG. 2, the shaving head of FIG. 6 is an example of the abovementioned Dual-Tilt-Following Retainer Embodiment. However, the shaving head of FIG. 6 is not an example of the abovementioned Snap Connection Secondary Tilt Embodiment. Instead, the shaving head of FIG. 6 is an example of the abovementioned Additional Tilting Ring Embodiment.

The configuration of the shaving head 103 as shown in FIG. 6 is highly similar to that of the shaving head 3 shown in FIG. 2. In fact, the shaving head 103 may be applied, instead of the shaving head 3, in the shaving device 1 of FIG. 1.

FIGS. 6, 7, 8A-8E are highly similar to FIGS. 2, 3, 5A-5E, respectively. In fact, the only essential difference with the embodiment of FIGS. 2, 3, 5A-5E, is that the cutting unit 107 (which is identical to the cutting units 107A and 107B) of the shaving head 103 is different from the cutting unit 7 of the shaving head 3 (best seen in FIG. 7).

The ring-like skin-supporting tilting member, the external cutting member, the internal cutting member, and the retainer of the cutting unit 107 are indicated by the reference numerals 171, 172, 173 and 174, respectively.

Figure 7:
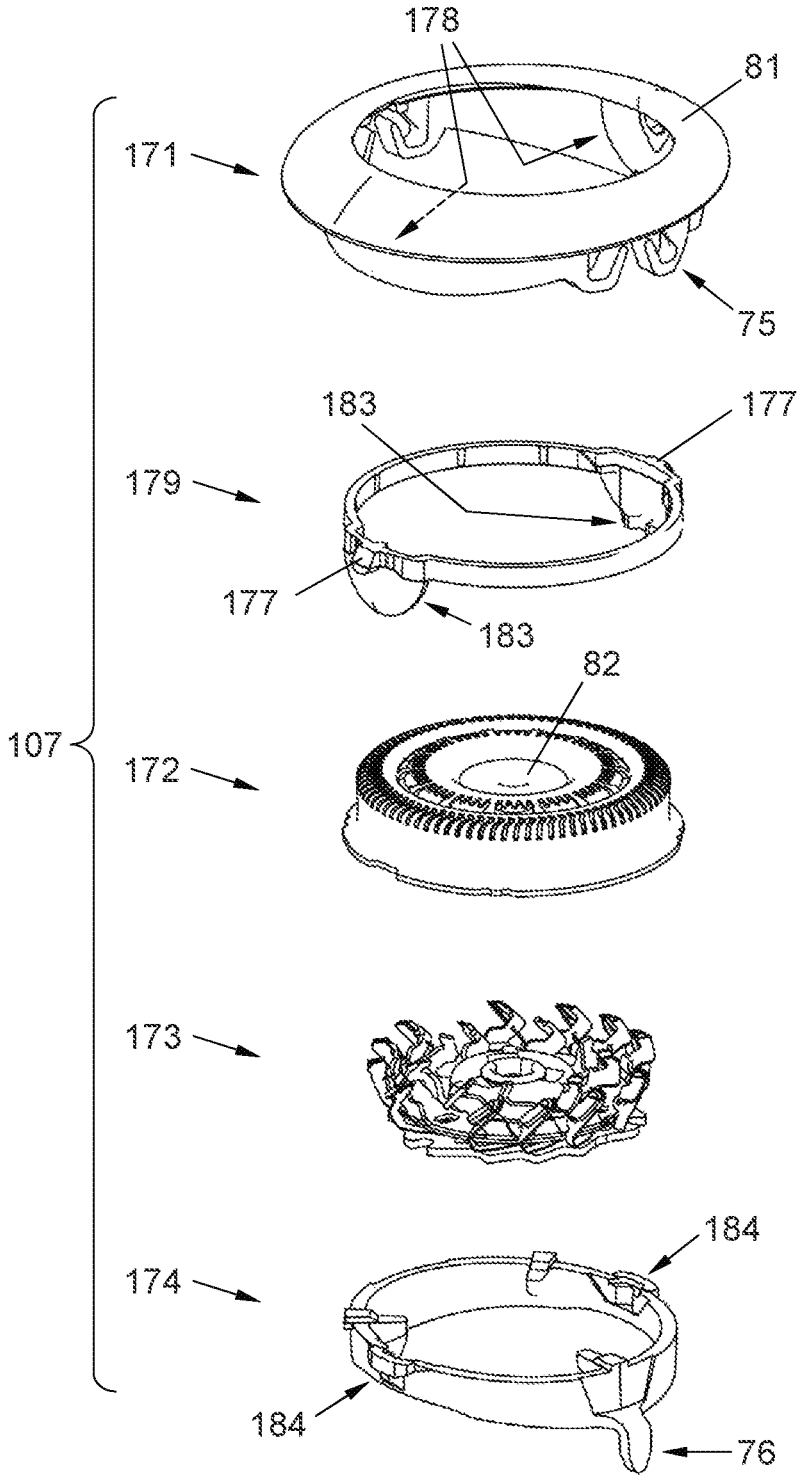
FIG. 7 separately shows, in a perspective view, one of the three identical cutting units of the shaving head of FIG. 6, in disassembled condition of the cutting unit shown.

The abovementioned ring-like additional tilting member of the cutting unit 107 is separately shown as part 179 in FIG. 7. In FIG. 7 it can be seen that the ring-like additional tilting member 179 has two opposed radially extending pin-like protrusions 177, hereinafter referred to as the fulcrum pins 177, while the ring-like skin-supporting tilting member 171 has a corresponding pair of two opposed radially extending recesses 178. In FIG. 7 it is additionally shown that the ring-like additional tilting member 179 furthermore has two opposed radially inwardly extending protrusions 183, hereinafter referred to as the inward protrusions 183, while the retainer 174 has two opposed radially outwardly extending protrusions 184, hereinafter referred to as the outward protrusions 184.

Starting from its disassembled condition, shown in FIG. 7, the cutting unit 107 can be brought into its assembled condition, shown in FIG. 6 and FIGS. 8A-8E, in the following manner. A user may first effectuate that the ring-like additional tilting member 179 is suspended relative to the ring-like skin-supporting tilting member 171 in the said second tiltable manner about the second tilting axis 12. This is achieved by inserting the fulcrum pins 177 of the ring-like additional tilting member 179 into the recesses 178 of the ring-like skin-supporting tilting member 171. Next, the user may insert the external cutting member 172 into the ring-like additional tilting member 179, the internal cutting member 173 into the external cutting member 172, and then lock this external cutting member 172 and this internal cutting member 173 in-between the ring-like additional tilting member 179 and the retainer 174 in the following manner. The retainer 174 may first be axially translated into the ring-like additional tilting member 179 up to a point where the outward protrusions 184 of the retainer 174 can be rotated, relative to the ring-like additional tilting member 179, around the axial direction so as to obtain a snap connection of the outward protrusions 184 with the inward protrusions 183 of the ring-like additional tilting member 179. Said relative rotation of the retainer 174 is made easier thanks to the finger grip elements 76. Disassembling the cutting unit 107 may of course be done by performing the abovementioned steps in reverse order.

Thus, in the assembled condition of the cutting unit 107, the fulcrum pins 177 are received in the recesses 178 in a pivotable manner. The result is that the external cutting member 172 is suspended relative to the ring-like skin-supporting tilting member 171 in the abovementioned second tiltable manner about a second tilting axis. This second tilting axis is indicated in FIGS. 8C-8E by reference numeral 12. It is noted that in said assembled condition the retainer 174 prevents the external cutting member 172 from translating in a direction transverse to the second tilting axis 12. It only allows the external cutting member 72 to tilt about the second tilting axis 12 as illustrated by FIGS. 8D and 8E.

From FIGS. 6, 7, 8A-8E it will now be clear that the retainer 174 simultaneously serves, inter alia, the multiple purposes as initially discussed herein, i.e. the "locking function", the "secondary tilting function", and the "anti-floating function". In other words, the shaving head 103 is in accordance with the abovementioned Multi-Purpose Retainer Principle. In addition, it is now clear that the retainer 174 in its locked condition simultaneously follows the tilting movement of the skin-supporting tilting member 171 relative to the shaving head main body 4, 8 about the first tilting axis 11, and the tilting movement of the external cutting member 172 relative to the ring-like skin-supporting tilting member 171 about the second tilting axis 12, which makes the shaving head 103 also a shaving head according to the abovementioned Dual-Tilt-Following Retainer Embodiment. Furthermore, it has been made clear that the shaving head 3 also is a shaving head according to the abovementioned Additional Tilting Ring Embodiment.

Figure 8A:
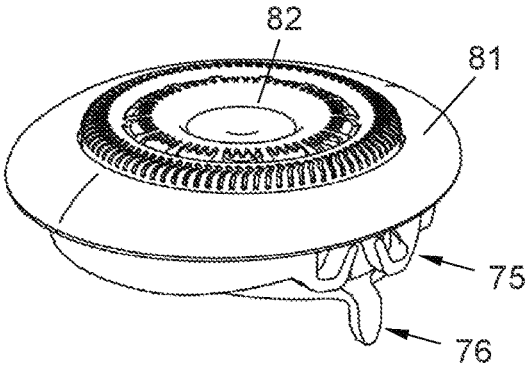
FIG. 8A shows, in a perspective view, the cutting unit of FIG. 7, however, this time in assembled condition of the cutting unit.
Figure 8B:
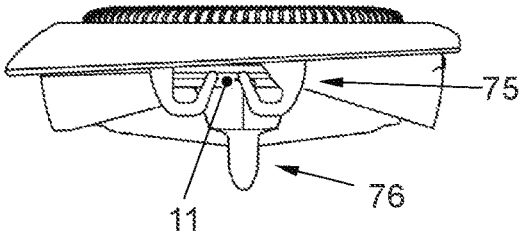
FIG. 8B again shows the assembled cutting unit of FIG. 7, however, this time in a first side view, which corresponds to a view in a direction parallel to the first tilting axis of the cutting unit shown.
Figure 8C:
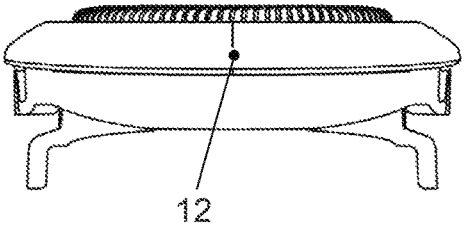
FIG. 8C again shows the assembled cutting unit of FIG. 7, however, this time in a second side view, which corresponds to a view in a direction parallel to the second tilting axis of the cutting unit shown.
Figure 8D:
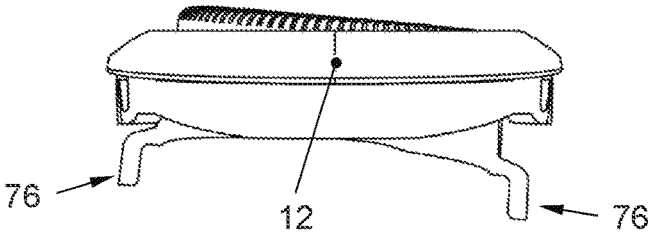
FIG. 8D again shows the situation of FIG. 8C, however, this time after, starting from the situation of FIG. 8C, the external cutting member has been tilted clockwise through a few degrees about the second tilting axis and relative to the ring-like skin-supporting tilting member.
Figure 8E:
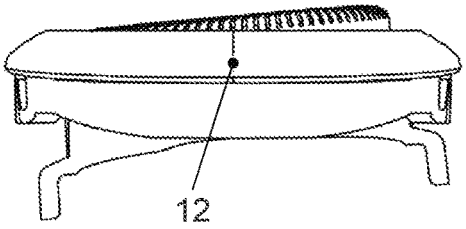
FIG. 8E again shows the situation of FIG. 8D, however, this time after said tilting through a few degrees has been performed in anti-clockwise direction.

As can best be seen in FIG. 8A, it is noted that the ring-like additional tilting member 179 is prevented from contacting skin during a shaving action.

Now, reference is made to FIGS. 9, 10, 11A, 11B, 12A, 12B, which illustrate a shaving head 203 according to the abovementioned Multi-Purpose Retainer Principle, more in particular according to the abovementioned Single-Tilt-Following Retainer Embodiment.

Figure 11A:
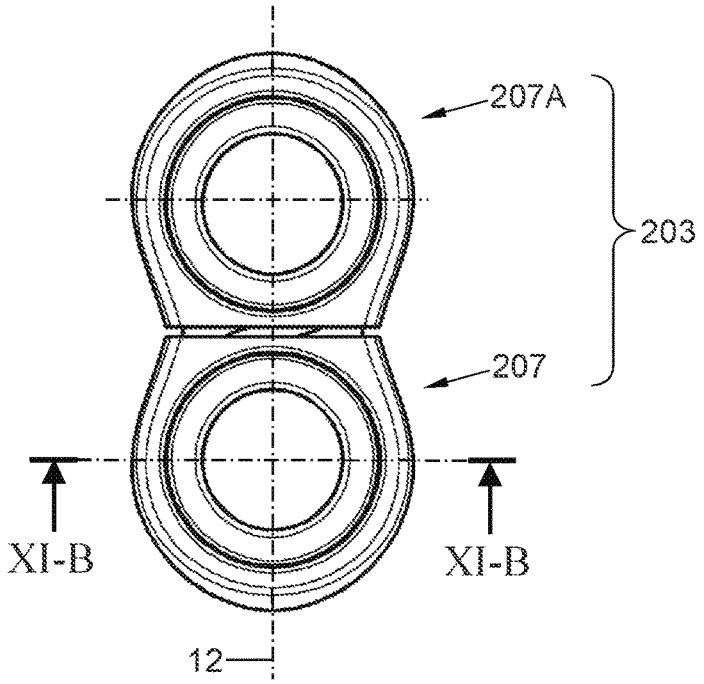
FIG. 11A shows, in a plan view, an example of an embodiment of a shaving head of the abovementioned Single-Tilt-Following Retainer Embodiment, wherein the shaving head of FIG. 11A has two cutting units, each one being identical to the cutting unit shown in FIGS. 9 and 10.
Figure 11B:
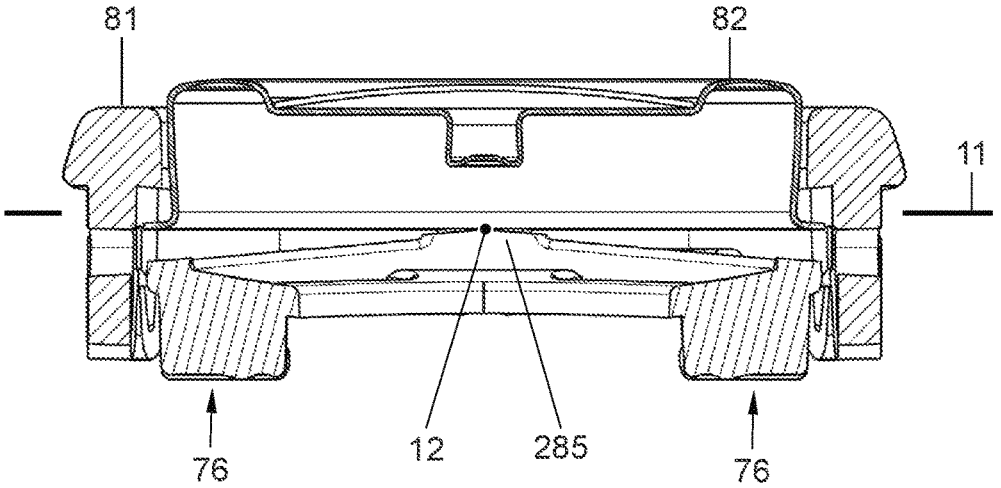
FIG. 11B shows, in assembled condition, one of the two identical cutting units of FIG. 11A in a transverse cross-sectional view, taken along the plane indicated by arrows XI-B in FIG. 11A, wherein said plane is viewed in the direction of said arrows XI-B, wherein said transverse cross-sectional view, which corresponds to a view in a direction parallel to the second tilting axis of the shown cutting unit, is partly a ghost view.

The configuration of the shaving head 203 as shown in FIG. 11A is similar to that of the shaving head 3 shown in FIG. 2. In fact, the shaving head 203 may be applied, instead of the shaving head 3, in the shaving device 1 of FIG. 1. One difference is that the shaving head 203 has two identical cutting units, indicated by reference numerals 207 and 207A, whereas the shaving head 3 has three identical cutting units.

FIGS. 9, 10, 11B, 12A and 12B are highly similar to FIGS. 3, 4, 5C, 5D, 5E, respectively.

In fact, the only essential difference with the embodiment of FIGS. 1, 2, 3, 4, 5A-5E, is that the cutting unit 207 of the shaving head 203 is different from the cutting unit 7 of the shaving head 3.

The ring-like skin-supporting tilting member, the external cutting member, the internal cutting member, and the retainer of the cutting unit 207 are indicated by the reference numerals 271, 272, 273 and 274, respectively.

From FIGS. 9 and 10 it will be appreciated that the retainer 274 has four, circumferentially spaced, radially extending protrusions 292, hereinafter referred to as the interlocking pins 292, while the ring-like skin-supporting tilting member 271 has four corresponding, circumferentially spaced, radially extending recesses 291, hereinafter referred to as the interlocking recesses 292. Furthermore, the retainer 274 has two opposed axially extending protrusions 76, hereinafter referred to as the finger grip elements 76.

Starting from its disassembled condition, shown in FIGS. 9 and 10, the cutting unit 207 can be brought into its assembled condition, shown in FIGS. 11A, 11B, 12A, 12B, in the following manner. A user may insert the external cutting member 272 into the ring-like skin-supporting tilting member 271, the internal cutting member 273 into the external cutting member 272, and then lock this external cutting member 272 and this internal cutting member 273 in-between the ring-like skin supporting tilting member 271 and the retainer 274 in the following manner. The retainer 274 may first be axially translated into the ring-like skin-supporting tilting member 271 up to a point where the interlocking pins 292 of the retainer 274 approximately are at the axial position of the interlocking recesses 291 of the ring-like skin-supporting tilting member 271. Next, the user may rotate the retainer 274, relative to the ring-like skin-supporting tilting member 271, around the axial direction so as to obtain a firm interlocking between the interlocking pins 292 and the interlocking recesses 291. Said relative rotation of the retainer 274 is made easier thanks to the finger grip elements 76. Disassembling the cutting unit 7 may of course be done by performing the abovementioned steps in reverse order.

Figure 9:
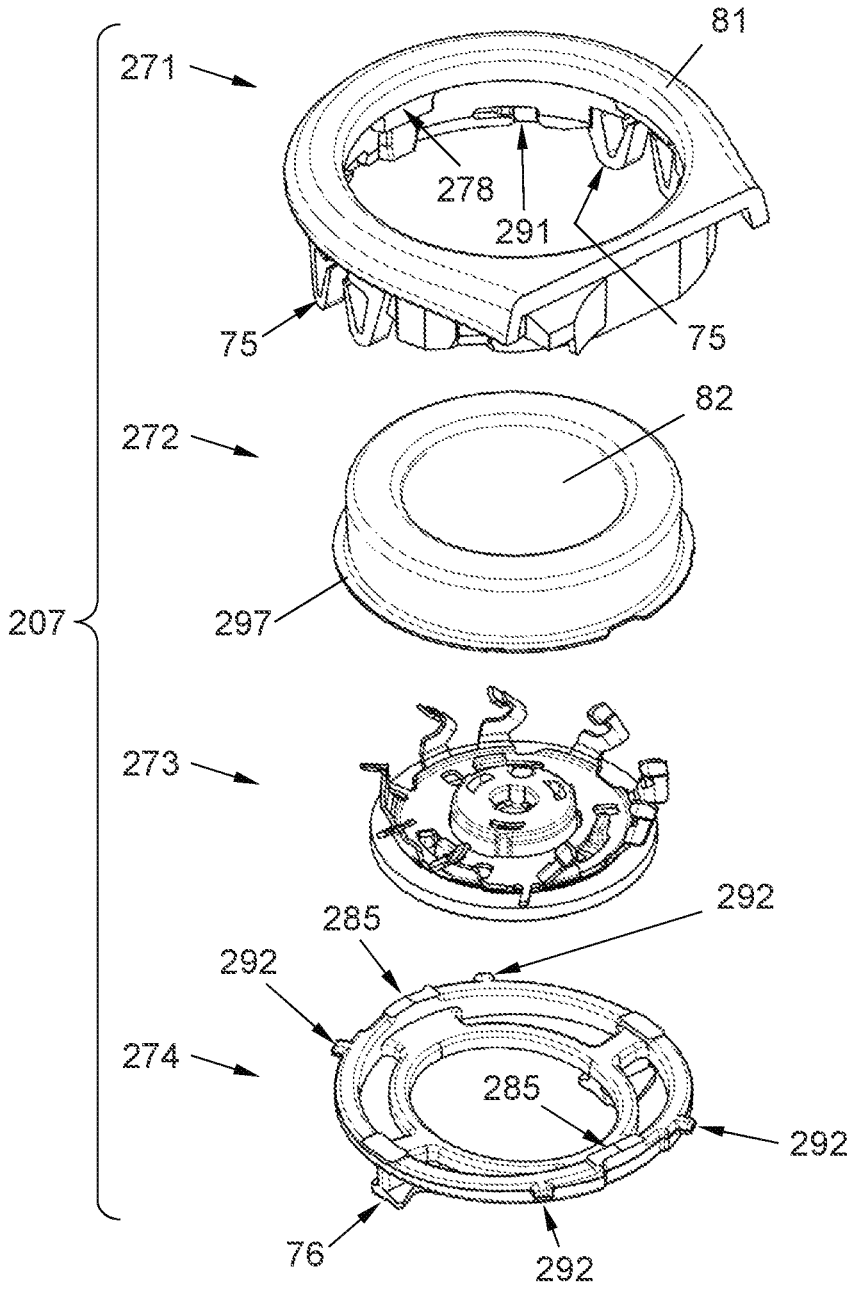
FIG. 9 shows, in a perspective view, a situation similar to that of FIG. 3, however, the cutting unit of FIG. 9 differs from that of FIG. 3 in that the cutting unit of FIG. 9 is an example of an embodiment of a cutting unit of a shaving head of the abovementioned Single-Tilt-Following Retainer Embodiment.
Figure 10:
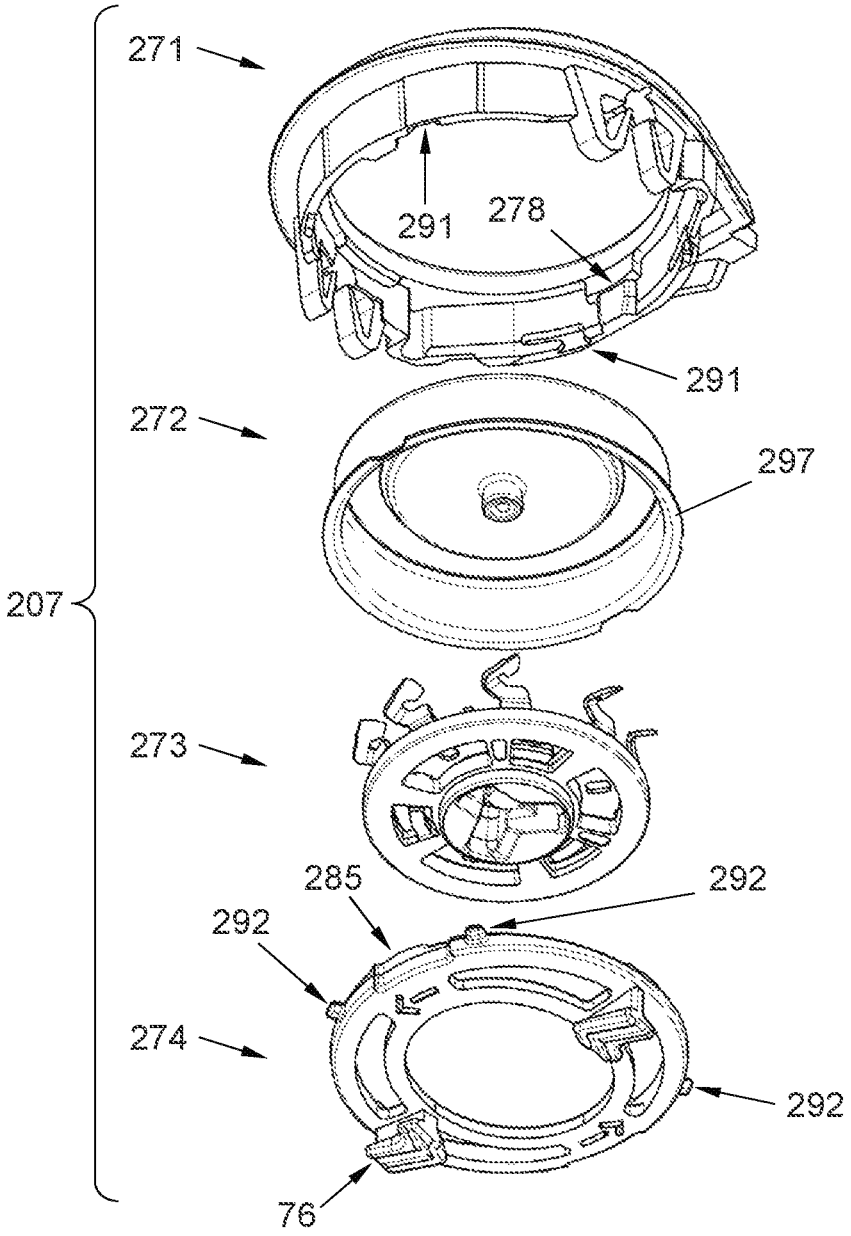
FIG. 10 shows the same situation as FIG. 9, however, the perspective view is taken in a different perspective direction.
Figure 12A:
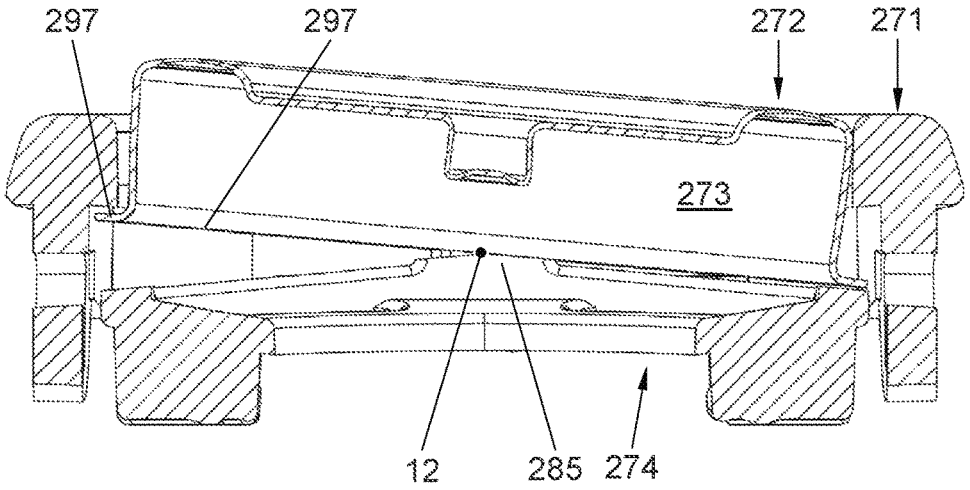
FIG. 12A shows the assembled condition of FIG. 11B again, however, this time after, starting from the situation of FIG. 11B, the external cutting member has been tilted clockwise through a few degrees about the second tilting axis and relative to the ring-like skin supporting tilting member.
Figure 12B:
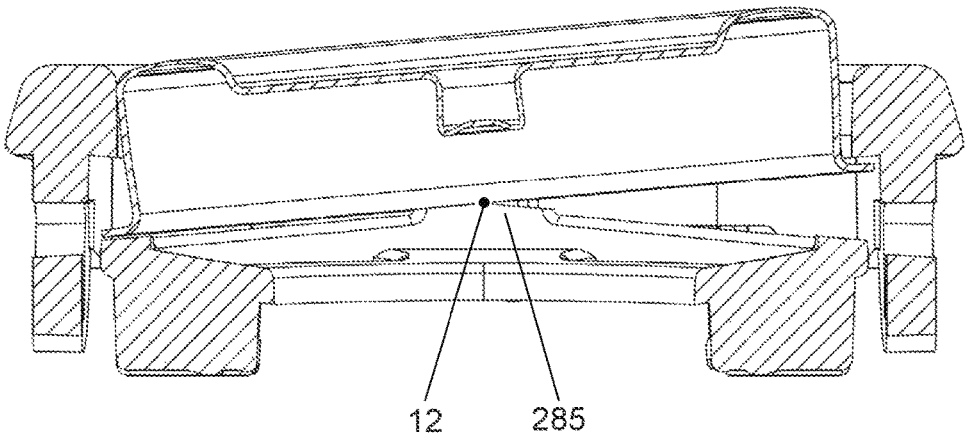
FIG. 12B also shows the situation of FIG. 11B, however, this time after said tilting through a few degrees has been performed in anti-clockwise direction.

From FIGS. 9 and 10 it will furthermore be appreciated that the retainer 274 has two opposed, axially extending, first wedge-shaped parts 285 having diametrically opposed first wedge apexes, while the ring-like skin-supporting tilting member 271 has two opposed, axially extending, second wedge-shaped parts 278 having diametrically opposed second wedge apexes. In the assembled condition of the cutting unit 207, the two respective first apexes of the two first wedge-shaped parts 285 face the two respective second apexes of the two second wedge-shaped parts 278. In the assembled condition of the cutting unit, the shown flange 297 of the external cutting member 272, at one location, is clamped in-between the first wedge apex of one of the two first wedge-shaped parts 285 and the second wedge apex of one of the two second wedge-shaped parts 278, while at a diametrically opposite other location, the flange 297 is clamped in-between the first wedge apex of the other one of the two first wedge-shaped parts 285 and the second wedge apex of the other one of the two second wedge-shaped parts 278. The result is that the external cutting member 272 is suspended relative to the ring-like skin-supporting tilting member 271 in the abovementioned second tiltable manner about a second tilting axis. This second tilting axis is indicated in FIGS. 11A, 11B, 12A, 12B by reference numeral 12. It is noted that in said assembled condition the retainer 274 prevents the external cutting member 272 from translating in a direction transverse to the second tilting axis 12. The external cutting member 272 is only allowed to tilt about the second tilting axis 12, as illustrated by FIGS. 12A and 12B.

From FIGS. 9, 10, 11A, 11B, 12A, 12B it will now be clear that the retainer 274 simultaneously serves, inter alia, the multiple purposes as initially discussed herein, i.e. the "locking function", the "secondary tilting function", and the "anti-floating function". In other words, the shaving head 203 is in accordance with the abovementioned Multi-Purpose Retainer Principle. In addition, it is now clear that in the assembled condition of the cutting unit 207, the retainer 274 in its locked condition follows the tilting movement of the skin supporting tilting member 271 relative to the shaving head main body in said first tiltable manner about the first tilting axis 11, but the retainer does not follow the tilting movement of the external cutting member 272 relative to the ring-like skin-supporting tilting member in said second tiltable manner about the second tilting axis 12. In other words, the shaving head 203 is a shaving head according to the abovementioned Single-Tilt-Following Retainer Embodiment.

It is remarked that each of the disclosed devices 7, 107 and 207 is an example of the abovementioned preferred embodiment of the invention, wherein the first tilting axis 11 and the second tilting axis 12 are perpendicular relative to one another.

It is furthermore remarked that each of the disclosed devices 7, 107 and 207 is an example of the abovementioned preferred embodiment of the invention, wherein the movement of the drivable internal cutting member comprises rotative movement about a rotation axis which is perpendicular to both the first tilting axis 11 and the second tilting axis 12.

While the invention has been described and illustrated in detail in the foregoing description and in the drawing figures, such description and illustration are to be considered as exemplary and/or illustrative and not in a limiting sense; the invention is not limited to the disclosed embodiments.

For example, according to the invention it is possible that the movement of the drivable internal cutting member, in addition or as an alternative to rotative movement, may also comprise reciprocative movement.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. For the purpose of clarity and conciseness of the description, features are disclosed herein as part of the same or separate embodiments, however, it will be appreciated that the scope of the invention may include embodiments having combinations of all or some of the features disclosed. The mere fact that certain measures are recited in mutually different dependent claims does not indicate that a combination of these measures cannot be used to advantage. Any reference signs in the claims should not be construed as limiting the scope.

The invention claimed is:

1. A shaving head for use in a shaving device for skin hairs, said shaving head comprising a shaving head main body and at least one cutting unit, wherein said cutting unit comprises:

a ring-like skin-supporting tilting member, which comprises a ring-like skin-supporting surface, and which comprises two opposed first suspension parts, which are located at mutually different locations along the ring-like skin-supporting tilting member, and via which the skin-supporting tilting member is suspended relative to the shaving head main body in a first tiltable manner about a first tilting axis;

an external cutting member comprising a skin-shaving surface, which is interrupted by an opening structure for allowing hairs to pass;

an internal cutting member, which is drivable for movement along said opening structure in the skin-shaving surface of the external cutting member, for cutting through hairs passing said opening structure; and a retainer;

and wherein:

said cutting unit has an assembled condition for operation of the shaving head and a disassembled condition for cleaning of the cutting unit, wherein the ring-like skin-supporting tilting member, the external cutting member, the internal cutting member and the retainer in the assembled condition and disassembled condition are, respectively, assembled and at least partly disassembled relative to one another;

in said assembled condition the cutting unit has a skin-contacting surface for contacting skin during a shaving action, said skin-contacting surface comprising said ring-like skin-supporting surface and said skin-shaving surface, wherein the skin-supporting surface at least partly surrounds the skin-shaving surface;

said assembled condition of the cutting unit is obtainable from said disassembled condition in an opened condition of the shaving head by manually bringing the retainer into a locked condition relative to other parts of the cutting unit, while said disassembled condition is obtainable from said assembled condition by manually bringing, in said opened condition of the shaving head, the retainer out of said locked condition;

the ring-like skin-supporting tilting member further comprises two opposed second suspension parts, which are located at mutually different locations along the ring-like skin-supporting tilting member, and via which, in said assembled condition, the external cutting member is suspended relative to the ring-like skin-supporting tilting member in a second tiltable manner about a second tilting axis, extending at a non-zero angle relative to said first tilting axis; and said locked condition of the retainer in said assembled condition of the cutting unit corresponds to a relative orientation of the retainer within the cutting unit, which relative orientation of the retainer effectuates:

(i) that the external cutting member is suspended relative to the ring-like skin-supporting tilting member in said second tiltable manner; and (ii) that the external cutting member is disabled to translate over more than a play distance of 2.0 millimeter in a direction transverse to said second tilting axis.

2. A shaving head according to claim 1, wherein, in said assembled condition of the cutting unit, in which the retainer is in its locked condition, the retainer simultaneously follows:

the tilting movement of the skin-supporting tilting member relative to the shaving head main body in said first tiltable manner about said first tilting axis; and the tilting movement of the external cutting member relative to the ring-like skin-supporting tilting member in said second tiltable manner about said second tilting axis.

3. A shaving head according to claim 2, wherein said two opposed second suspension parts of the ring-like skin-supporting tilting member comprise a first snap connection structure co-operating with a second snap connection structure of the retainer, wherein said locked condition of the retainer in said assembled condition of the cutting unit is provided by a snap connection between the first snap connection structure and the second snap connection structure.

4. A shaving head according to claim 2, wherein the cutting unit further comprises a ring-like additional tilting member, and wherein, as seen in the assembled condition of the cutting unit:

the ring-like additional tilting member is assembled together with the ring-like skin-supporting tilting member, the external cutting member, the internal cutting member and the retainer;

said ring-like additional tilting member is suspended relative to the ring-like skin-supporting tilting member in said second tiltable manner via said two opposed second suspension parts of the ring-like skin-supporting tilting member; and said ring-like additional tilting member comprises a third snap connection structure co-operating with a fourth snap connection structure of the retainer, wherein said locked condition of the retainer in said assembled condition of the cutting unit is provided by a snap connection between the third snap connection structure and the fourth snap connection structure.

5. A shaving head according to claim 4, wherein, as seen in the assembled condition of the cutting unit, the ring-like additional tilting member is prevented from contacting skin during the said shaving action.

6. A shaving head according to claim 1, wherein, in said assembled condition of the cutting unit, in which the retainer is in its locked condition, the retainer follows the tilting movement of the skin-supporting tilting member relative to the shaving head main body in said first tiltable manner about said first tilting axis, but the retainer does not follow the tilting movement of the external cutting member relative to the ring-like skin-supporting tilting member in said second tiltable manner about said second tilting axis.

7. A shaving head according to claim 6, wherein:

the ring-like skin-supporting tilting member comprises a first interlocking structure and the retainer comprises a second interlocking structure, said first interlocking structure co-operating with said second interlocking structure for realizing said locked condition of the retainer in said assembled condition of the cutting unit;

the two second suspension parts of the ring-like skin-supporting tilting member comprise two first abutment parts, respectively;

and wherein, as seen in said locked condition of the retainer in said assembled condition of the cutting unit:

the retainer comprises two second abutment parts, which are opposite to the two first abutment parts, respectively, with a first part of the external cutting member lying in-between one of the two first abutment parts and one of the two second abutment parts, opposite to said one first abutment part, and with a second part of the external cutting member lying in-between the other of the first abutment parts and the other of the second abutment part; and said second tilting axis passes through said first part of the external cutting member and through said second part of the external cutting member, while abutment action of the first abutment parts and of the second abutment parts disable the external cutting member to translate in a direction transverse to said second tilting axis.

8. A shaving head according to claim 1, wherein the first tilting axis and the second tilting axis are perpendicular relative to each other.

9. A shaving head according to claim 1, wherein said movement of the drivable internal cutting member comprises rotative movement about an axis of rotation which is perpendicular to both the first tilting axis and the second tilting axis.

10. A shaving device for skin hairs, comprising:

a shaving device main body which is intended to be taken hold of by a user of the shaving device, and which serves for accommodating various members of the shaving device; and a shaving head according to claim 1, the shaving head being connected or connectable to the shaving device main body for operation of the shaving device.

* * * * *